United States Patent [19]

Strong

[11] Patent Number: 4,827,989

[45] Date of Patent: May 9, 1989

[54] WOOD CHIPPER WITH REMOVABLE VERTICAL ANVIL

[76] Inventor: Donald E. Strong, 498 Eight Mile Rd., Remus, Mich. 49340

[21] Appl. No.: 166,928

[22] Filed: Mar. 11, 1988

[51] Int. Cl.[4] ..... B27C 1/00

[52] U.S. Cl. ..... 144/176; 241/92

[58] Field of Search ..... 144/162 R, 176, 172, 144/174; 241/92, 93, 94

[56] References Cited

U.S. PATENT DOCUMENTS

| | | | |
|---|---|---|---|
| Re. 26,323 | 12/1967 | Fontaine | 144/176 |
| 1,906,486 | 5/1933 | Payzer | 144/176 |
| 2,566,938 | 9/1951 | Johnson | 241/92 |
| 2,712,904 | 7/1955 | Durkee | 241/92 |
| 3,000,578 | 9/1961 | Riches et al. | 241/92 |
| 3,032,281 | 5/1962 | Wexell | 241/92 |
| 3,332,461 | 7/1967 | Ledergerber | 144/176 |
| 3,542,302 | 11/1970 | Salzmann, Jr. | 144/176 |
| 3,844,489 | 10/1974 | Strong | 144/176 |

OTHER PUBLICATIONS

A parts list and exploded view of a chipper assembly for a Trelan model wood chipper from Strong Manufacturing Company, 498 Eight Mile Road, Remus, Michigan 49340. (Publication Date Unknown).

Cutaway view of the knife arrangement of the same Trelan model wood chipper from Strong Manufacturing Company.

*Primary Examiner*—W. Donald Bray

*Attorney, Agent, or Firm*—Varnum, Riddering, Schmidt & Howlett

[57] ABSTRACT

A wood chipper (40) for chipping wood, such as logs, into wood chips, has a chipping block (80) including one or more chipping knives (96) rotatably mounted in a housing (42l). An input aperture (60) on one face of the housing (42) receives material to be chipped, and a discharge chute (58) extends tangentially from the periphery of the housing (42) to exhaust chips therefrom. Primary and secondary wear blocks (68, 69) having hardened wear surfaces, are mounted at the input aperture (60) of the housing (42), against which incoming wood material abuts as it is fed into the chipper (40). The primary wear block (68) is mounted on a support bracket (66) and adjustable relative to the axial position of the chipper knives (96). The secondary wear block (69) is adapted to be mounted to the housing (42) at an inward edge of the input aperture (60), so that it can be easily removed.

9 Claims, 3 Drawing Sheets

WOOD CHIPPER WITH REMOVABLE VERTICAL ANVIL

BACKGROUND OF THE INVENTION

1. Field of the Invention

This invention relates to rotary wood chippers for reducing wood materials into chips and more particularly to woodchippers with an improved wear block configuration.

2. Description of the Prior Art

In tree trimming or removal operations, limbs and other scrap wood material must be disposed of, which in the past has been accomplished by burning the scrap wood or delivering it to a landfill. In populated areas, burning undesirably increases the pollution content of the air. Shipment to landfill is expensive and the amount of available space for landfill disposal is becoming increasingly limited. Recently, the scraps have been reduced to wood chips which can then be employed for paper manufacture or, in some cases, used as a mulch around shrubs and the like. It is not generally feasible, however, to truck the wood scraps to a mill for processing in wood chippers since the expense of the gathering and shipping frequently outweighs the value of the resulting wood chips.

Some wood chippers have been designed which are portable and which are capable of processing at least small branches into wood chips which then can be gathered at the site of the tree trimming operation or can be distributed on the ground whereupon the chips will decay naturally without causing environmental damage. Some existing portable wood chippers, however, are generally not capable of handling relatively large limbs or medium sized trees (i.e., with diameters up to 15 inches). This problem is due to the relatively lightweight construction of the trailer-hauled portable wood chippers which are designed primarily for very small branches and not general duty purposes. On the other hand, existing wood chippers which are designed for larger pieces of wood material are extremely heavy and cannot easily be transported; or in cases where heavy duty chippers have been mounted on large trailers, the cost of the unit is prohibitive for small operators. Thus, there existed a need for a relatively heavy duty and yet portable chipper unit which was not overly costly.

U.S. Pat. No. 3,844,489 issued Oct. 29, 1974 disclosed an improved wood chipper comprising a generally rectangular chipping block having at least one aperture extending through the block and a chipper knife positioned on the edge of the aperture. Positioned on flat top and bottom edges of the rectangular block are chip clearing fan blades. The chipping block is enclosed and rotatably mounted in a housing which has an input aperture on one face for receiving material to be chipped and a discharge chute extending tangentially from the periphery thereof for removal of wood chips. The housing is mounted on a suitable framework at an acute angle relative to the direction of feed such that the chipper knife tends to draw the material into the chipper. Thus, a chipper with such a configuration is known as a slant disk wood chipper. Rotation of the chipping block is facilitated by a rotary shaft mounted between a pair of bearing block assemblies bolted to the outside of the housing. The bearing assemblies are of conventional design. A wear block also sometimes referred to as an anvil, having hardened wear surfaces, is horizontally mounted at a lower portion of the input aperture in closely spaced relationship to the chipper block. Material being fed into the chipper rides over the anvil which supports the material as the chipper knife slices the material into chips. Chip size is determined by adjusting the position of each knife in the chipping block. Prior art wood chippes of the type disclosed in the '489 patent and sold by strong Mfg. Co. incorporated a horizontal anvil that was adjustably mounted at a lower portion of the input aperture. The anvil could therefore be positioned to maintain appropriate tolerance with respect to the chipper knives.

In addition to drawing the material into the chipper, the rotating chipper block tends to force some of the material laterally toward the axis of rotation where the material tends to bunch up against an inside edge of the input aperture. To facilitate the cutting action at the inside edge, a second wear block having hardened wear surfaces is typically welded to the edge at approximately a right angle to the horizontal anvil. Maintenance of such a secondary wear block is difficult. Sharpening the edge of the vertical anvil requires dismantling at least a portion of the chipper, or, alternatively, building up the edge in place from an awkward angle. In the first instance, the chipper is unusable for an extended period. In the second instance, a sufficiently sharpened edge is not possible. Likewise, adjustment of the secondary wear block to correspond to adjustment of the horizontal anvil is very difficult.

SUMMARY OF THE INVENTION

The invention relates to a wood-chipping apparatus of the type which has a housing with an inlet opening for feeding wood into the housing and an outlet opening for discharging wood particles from the housing, a chipper block rotatably mounted on a shaft within the housing for chipping logs fed through the inlet opening, and primary and secondary wear block means on the housing in closely spaced relationship to the chipper block. According to the invention, means are provided for removably mounting the secondary wear block means to the housing. Preferably, the removable mounting means comprise bolts which extend through a portion of the housing at the access opening and thread into a secondary wear block element.

The wood-chipping apparatus is the type in which a bearing means support a shaft which mounts the chipper block on one side of the housing and the bolts also mount the bearing onto the housing. Means are provided to adjust the distance between the secondary wear block means and the rotating chipper block.

The wood-chipping apparatus is the type which comprises a fan mounted to an outlet side of the chipping block to propel wood particles through the outlet opening of the housing. Further, the shaft is preferably mounted at an acute angle to a horizontal plane with an in-feed end thereof being lower than an outlet end thereof.

The invention provides a lightweight and relatively portable chipper which is able to accommodate many different sizes of logs. The invention provides for the replacement and/or adjustment of the secondary wear block in the field without having to spend extensive time and effort on disassembly of the machine or professional assistance. Further, the easy removal of the secondary wear block from the housing permits sharpening thereof in a fairly simple manner and thus avoids the necessity of trying to sharpen the secondary wear block within the housing. It also avoids the necessity of trying to build up an edge of the secondary wear block in place from a relatively awkward and difficult angle. Thus, by removing the secondary wear block from the housing, a very sharp edge can be obtained. Further, by proper placement and adjustment of the secondary wear block when replacing the same in the housing, an appropriate distance between the chipping block and the secondary wear block can be maintained.

BRIEF DESCRIPTION OF THE DRAWINGS

The invention will now be described with reference to the accompanying drawings in which.

DETAILED DESCRIPTION OF THE PREFERRED EMBODIMENT

Figure 1:
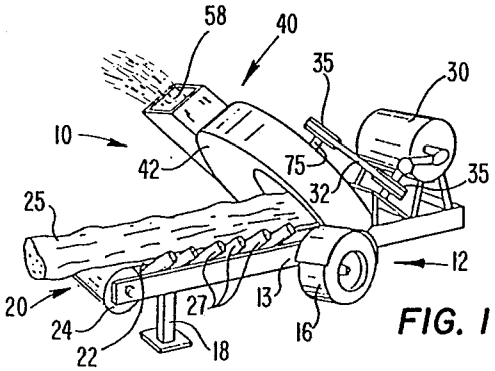
FIG. 1 is a perspective view showing a portable wood chipping apparatus mounted on a trailer and including an in-feed conveyor for use therewith.

Referring now to FIG. 1, there is shown a portable wood chipping apparatus 10 comprising a trailer 12 having a frame 13 mounted on an axle 14 with a pair of wheels 16. Suitable hitch means (not shown) are provided for coupling the trailer to a towing vehicle to transport the wood chipper. The trailer includes a retractable stand 18 which can be lowered to support the trailer such that the towing vehicle can be removed if desired when the chipper apparatus is in use. The wood chipping apparatus further includes feed means 20 such as a belt conveyor 22 which is supported between a pair of rollers 24 (one shown in the figure) to transport a log 25, branches, or other wood material into the chipping apparatus. A plurality of guide rollers 27 are positioned at an acute angle to the horizontal on either side of the belt conveyor 22 to provide guidance for the movement of the log 25 into the chipper 40. Any suitable means of feeding material into the chipper 40 can be provided. The conveyor 22 can be driven by suitable conventional drive means such as a motor (not shown) in a conventional fashion. In some embodiments, the powered conveyor will be unnecessary and a trough can be employed for manually feeding material to the chipper.

Positioned at the output end of the conveyor 22 is the wood chipper 40 which comprises a chipper housing 42 which encloses the rotating portions of the wood chipper 40 and provides controlled discharge of the wood chips from a discharge chute 58. A power drive means 30 such as a gasoline or diesel powered engine is positioned to be coupled to a drive shaft 75 of the wood chipper 40. The coupling mechanism can be a pulley 35 and belt 32 as shown in FIG. 1 or any suitable gearbox.

Figure 2:
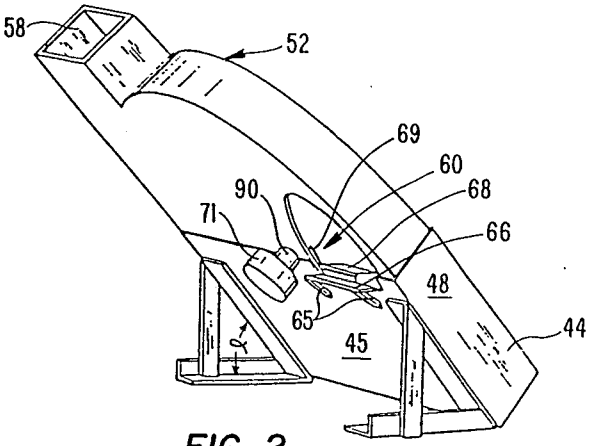
FIG. 2 is an enlarged perspective view of the chipping apparatus prior to mounting on the trailer.
Figure 4:
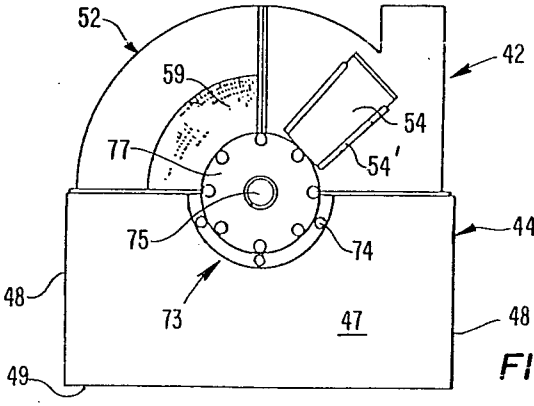
FIG. 4 is a rear elevational view of the housing.
Figure 3:
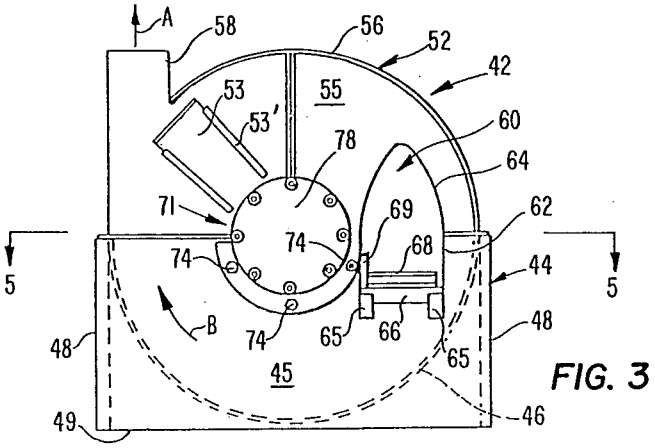
FIG. 3 is a front elevational view of the chipper housing.

Referring now to FIGS. 2 through 4, it is seen that the chipper housing 42 includes a rectangular base 44 having front and rear surfaces 45 and 47, respectively, joined by side walls 48 and a bottom panel 49. Brackets 43, suitably attached to the base 44, are employed to mount the housing on trailer 12 at an acute angle (FIG. 2) of approximately 37° to the direction of feed of material into the chipper. Within the rectangular base is mounted a semicircular plate 46 which prevents the corners of the base from being clogged with wood chips during operation of the rotary chipper.

The chipper housing 42 includes an upper portion 52 which is securely attached to the base 44 by suitable fastening means and which includes front and rear semicircular plates 55 and 57, respectively. A curved side wall 56 joins the front and rear plates and a rectangular discharge chute 58 extends tangentially from one side of the upper portion of the housing as shown in the figures. The front plate includes a slide plate 53 mounted within guide brackets 53' to provide access to the chipper block for knife replacement or adjustment. The rear plate likewise includes a similar sliding plate 54 with guide means 54'. A screened air inlet 59 is provided in plate 57 to permit the entry of air which is circulated by the chipper and aids in exhausting chips from the discharge chute 58 in a direction indicated by the arrow A in FIG. 3. The direction of rotation of the chipper knives is indicated by arrow B in FIG. 3.

As shown in FIGS. 2 and 3, a material feed opening 60 is provided in the front surfaces of sections 52 and 44 and includes a rectangular bottom segment 62 formed in the base member 44, and a curved top portion 64 in the top section 52 of the chipper housing 42. A support plate 66 extends outwardly from the bottom edge of aperture 60 and is supported by suitable brackets 65 extending between the bottom surface of the plate and the front of the base. Adjustably positioned on the support plate 66, by the use of bolts 104 in elongated holes 106 in the support plate 66, for example, is a primary wear block 68 which has hardened wear surfaces 114 over which the log 25 rides as it is being fed into the chipper. The primary wear block 68 is mounted in closely spaced relationship to the rotating knives 96.

Figure 5:
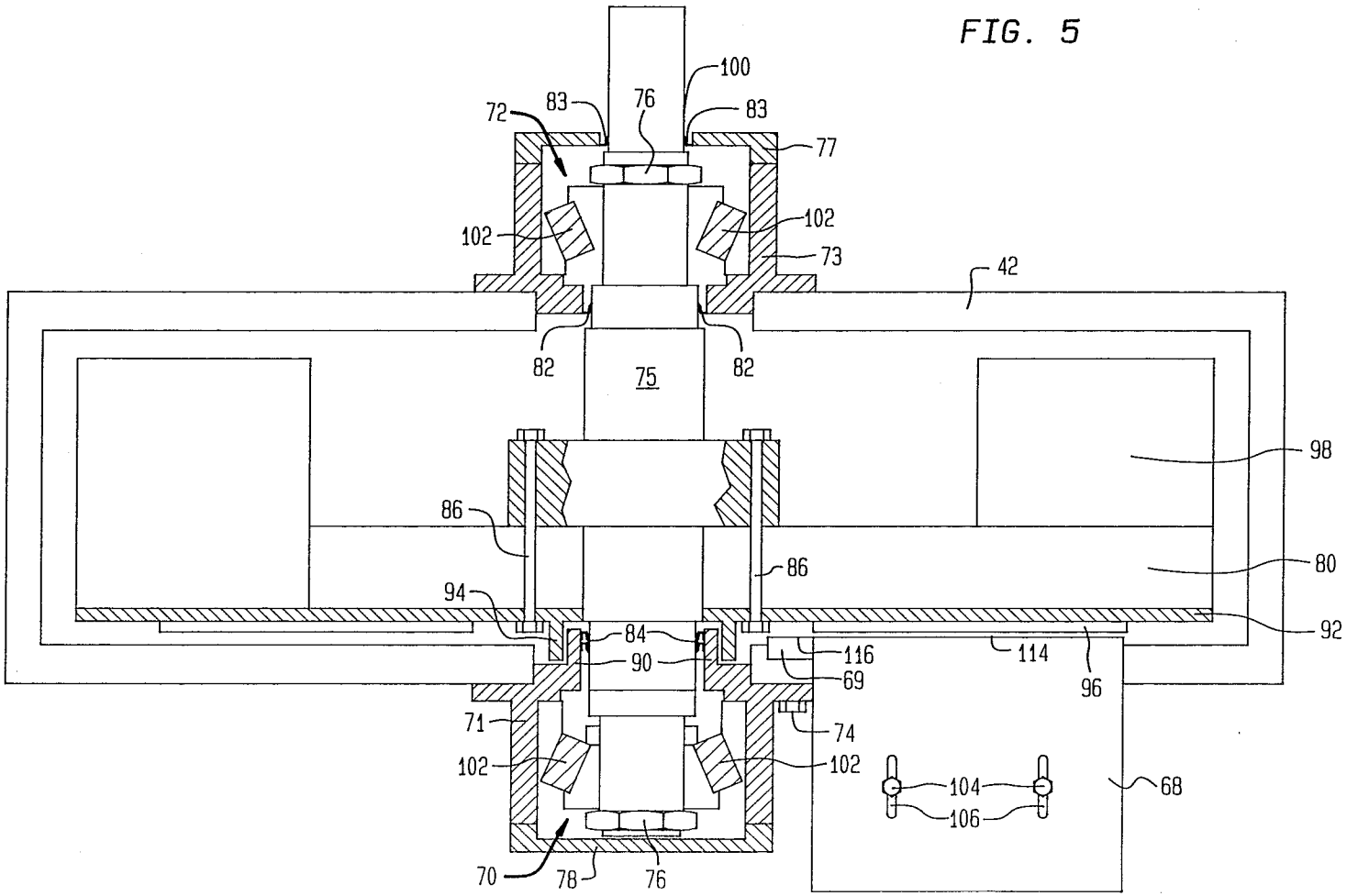
FIG. 5 is a cross-sectional view of the chipper taken along the lines 5—5 of FIG. 3.
Figure 6:
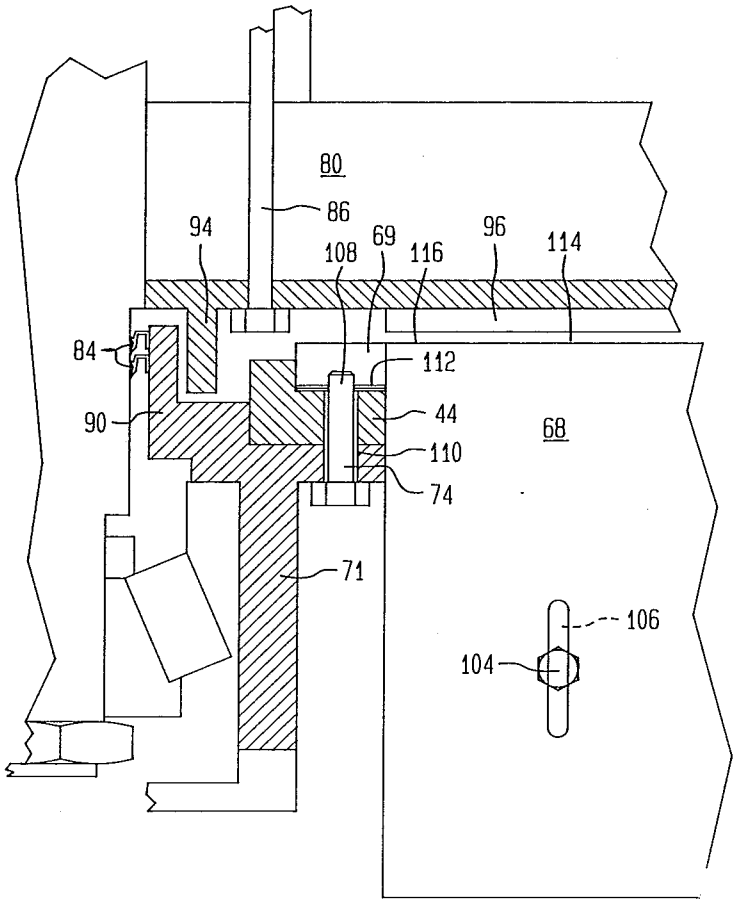
FIG. 6 is an enlarged view of a portion of FIG. 5 to show more detail of the secondary wear block.

Mounted on the interior of housing 42 at an inward edge of aperture 60 and extending vertically upward from the primary wear block 68 is a secondary wear block 69, as shown in FIGS. 2, 3, 5, and 6. The secondary wear block 69 can be made of steel, having hardened wear surfaces 116 similar to the primary wear block 68, against which the material abuts as the material is fed into the chipper. A plurality of threaded holes 108, preferably three, are drilled into the surface of the secondary wear block that faces the interior of housing 42. Machined bolts 74 are mounted from the outside through apertures 110, preferably in base member 44, into the threaded holes 108 to secure the secondary wear block to the interior of the housing 42. At least one of the bolts 74 can simultaneously secure a lower bearing housing 71 to the base 44 as shown in FIG. 5 and further described hereinafter. The thickness of the secondary wear block 69 is such that the clearance between the secondary wear block 69 and chipper knives 96 affixed to a rotating chipper block 80 as hereinafter described is approximately the same as the clearance between the primary wear block 68 and the chipper knives 96 in closely spaced relationship to the rotating knives 96. Removal of the second wear block 69 is thus facilitated by unscrewing the bolts 74 from the outside, without having to dismantle the chipper. Once removed, the secondary wear block 69 can be reworked to sharpen the edges of the wear surfaces, replaced, or adjusted as hereinafter described. Mounted centrally to the base 44 on opposite sides thereof are a lower bearing assembly 70 and an upper bearing assembly 72. Suitable machine bolts 74 bolt the bearing assemblies 70 and 72 the chipper housing 42 by means of a lower bearing housing 71 and an upper bearing housing 73, respectively, as seen in FIGS. 4 and 5. The bearing assemblies 70 and 72 support the rotary shaft 75 on the base 44.

As shown further in FIG. 5, the bearing assemblies comprise conventional tapered roller bearings 102 of the type made by Timken Corporation, and are each secured around the shaft 75 by means of a lock nut 76. An upper bearing seal 82 is interposed between the rotary shaft 75 and an interior portion of the upper bearing housing 73. An upper bearing cap 77 having a central aperture 100 through which the shaft 75 extends is bolted to the upper bearing housing 73 to completely enclose the upper bearing assembly 72. A seal 83 for the upper bearing cap 77 surrounds the shaft 75 to protect the upper bearing assembly 72. The lower bearing housing 71 has a portion 90 extending axially along the shaft 75 to the interior of the chipper housing 42 near the chipper block 80. There, interposed between the rotary shaft 75 and the extension 90 of the lower bearing housing, is a lower bearing seal 84. A lower bearing cap 78 mounts to the exterior portion of the lower bearing housing 71 to completely enclose the lower bearing assembly 70.

A chipper block 80 of the type described in U.S. Pat. 3,844,489, the disclosure of which is incorporated herein by reference, is mounted to the shaft by bolts 86. The bolts 86 also mount a circular wear plate 92 to the chipper block 80. A tubular collar 94 of a diameter slightly greater than the diameter of the extension 90 of the lower bearing housing is mounted, preferably by welding, centrally to the wear plate 92 to form a shield around the lower bearing housing extension 90. Suitable knife assemblies 96, of a type, for example, described in U.S. Pat. No. 3,844,489, are affixed to the chipper block 80 and extend through slots in the wear plate 92.

Fan blades 98 are mounted to the chipper block 80 and extend rearwardly therefrom. Mounted as shown in FIG. 5, the fan blades 98 effectively draw air through intake 59 and exhaust air through chute 58 as the chipper block rotates. The wood chips, which pass through the slots in the wear plate 92 and chipper block 80, are carried by the air stream or physically thrown by the blades to be discharged from the chipper housing.

In operation, the sharpened edges of the knife assemblies 96 rotating with the wear plate 92 and chipper block 80 contact the end of log 25 resting against the primary and secondary wear blocks 68, 69 and cut the log into chips which are then forced, partly by the knives, partly by their momentum and partly by the air flow created by the fan blades through the chipper block 80. In addition to providing a current of air to exhaust the chips, the fan blades 98 physically contact the chips and tend to throw them out of the exhaust chute 58.

It is desirable to be able to obtain different sizes of wood chips from the chipper. To this end, the position of the knives 96 is adjustable inwardly and outwardly with respect to the rotating chipper block as described in U.S. Pat. No. 3,844,489. Positioning the knives further outwardly of the chipper block increases chip size and positioning the knives further inwardly of the chipper block decreases chip size. It is important to maintain a closely spaced relationship between the knives 96 and the primary wear block. Accordingly, the primary wear block 68 is positionally adjustable with respect to the rotating knives 96. When the position of the knives 96 is adjusted in the chipping block 80 the primary wear block can be correspondingly adjusted by loosening bolts 104, sliding the primary wear block 68 so as to obtain the desired clearance between the rotating knives 96 and the primary wear block 68, and then retightening the bolts 104. Preferably, the desired clearance is approximately 0.020 in. to 0.100 in., although the exact amount is not critical.

It is also necessary to be able to adjust the secondary wear block 69 in order to maintain approximately the same clearance from the rotating knives 96 as the primary wear block 68. Where previous chippers had secondary wear blocks welded in plate, such adjustment either was not possible, or at best, extremely difficult. It required dismantling the chipper sufficiently to permit cutting the wear block and reworking the hardened wear surface on the wear block to increase the clearance, or building up layers and reworking the wear surface to decrease the clearance. In either case, obtaining and maintaining sufficiently sharpened edges was very difficult because of the awkward work angle required by the configuration of the chipper. According to the invention, the secondary wear block 69 can be adjusted inwardly and outwardly with respect to the rotating knives 96 by simply inserting or removing shims 112 between the secondary wear block 69 and the chipper housing 42.

Alternatively, a series of secondary wear blocks 69, each having a different thickness, can be provided. The secondary wear block 69 can be simply replaced by one of appropriate thickness corresponding to the desired chip length and clearance. Replacement is facilitated by the easy removability of the secondary wear block 69. Maintenance of the sharpness and the wear surfaces 116 of the secondary wear block is also easier, thus insuring a continuing higher quality of wood chip, and uniformity of chip side.

Reasonable variation and modification are possible within the spirit of the foregoing specification and drawings without departing from the scope of the invention which is defined in the accompanying claims.

The embodiments of the invention in which an exclusive property or privilege is claimed are defined as follows:

1. In a wood-chipping apparatus comprising:

a housing having an inlet opening for receiving wood into said housing and an outlet opening for discharging wood particles from said housing;

a chipper block within said housing for chipping wood fed through said inlet opening;

a shaft mounting said chipper block in said housing for rotation about a longitudinal axis;

primary and secondary wear block means mounted directly on said housing and partly defining said inlet opening in closely spaced relationship to said chipper block and each having hardened wear surfaces, against which wood is positioned for cutting by said chipper block; and means for rotating said chipper block about the longitudinal axis of said shaft;

the improvement which comprises:

means for removably mounting the secondary wear block means to said housing as a discrete element to accomodate sharpening the hardened wear surfaces or exchanging the secondary wear block means for another when said secondary wear block means is removed.

2. A wood-chipping apparatus according to claim 1 wherein said removable mounting means comprise bolts which extend through a portion of said housing at said inlet opening and thread into said secondary wear block means.

3. A wood-chipping apparatus according to claim 2 and further comprising bearing means to support said shaft on one side of said housing at least one of said bolts also mount said bearing means to said housing.

4. A wood- chipping apparatus according to claim 3 and further comprising means to adjust the distance between said secondary wear block hardened wear surface and said rotating chipper block.

5. A wood-chipping apparatus according to claim 4 and further comprising fan means mounted to an outlet side of said chipping block to propel wood particles through said outlet opening of said housing.

6. A wood-chipping apparatus according to claim 5 wherein said shaft is mounted at an acute angle to a horizontal plane with an in-feed end thereof being lower than an outlet end thereof.

7. A wood-chipping apparatus according to claim 3 wherein said shaft is mounted at an acute angle to a horizontal plane with an in-feed end thereof being lower than an outlet end thereof.

8. A wood-chipping apparatus according to claim 1 and further comprising means to adjust the distance between said secondary wear block hardened wear surface and said rotating chipper block.

9. A wood-chipping apparatus according to claim 8 wherein said distance adjusting means comprises at least one shim mounted between said housing and said secondary wear block means.

* * * * *

UNITED STATES PATENT AND TRADEMARK OFFICE

CERTIFICATE OF CORRECTION

PATENT NO. : 4,827,989

DATED : May 9, 1989

INVENTOR(S) : DONALD E. STRONG

It is certified that error appears in the above-identified patent and that said Letters Patent is hereby corrected as shown below:

In the Abstract, line 4, "(421)" should be --(42)--.

Col. 2, line 7, "strong" should be --Strong--.

Col. 4, line 64, start a new paragraph beginning with "Mounted"

Col. 6, line 11, "plate," should be --place,--.

Col. 7, line 5, after "housing" insert --,--.

Col. 7, line 7, "wood- chipping" should be --wood-chipping--.

Signed and Sealed this

Twentieth Day of February, 1990

*Attest:*

JEFFREY M. SAMUELS

*Attesting Officer*

*Acting Commissioner of Patents and Trademarks*